United States Patent [19]

Ota et al.

[11] 4,219,972

[45] Sep. 2, 1980

[54] CONTROL APPARATUS FOR A GRINDING MACHINE

[75] Inventors: Masato Ota; Kisaburo Koike, both of Narashino, Japan

[73] Assignee: Seiko Seiki Kabushiki Kaisha, Chiba, Japan

[21] Appl. No.: 950,996

[22] Filed: Oct. 13, 1978

[30] Foreign Application Priority Data

Oct. 17, 1977 [JP] Japan ..... 52/139008[U]
Oct. 17, 1977 [JP] Japan ..... 52/139009[U]
Oct. 17, 1977 [JP] Japan ..... 52/139010[U]

[51] Int. Cl.[2] ..... B24B 53/00

[52] U.S. Cl. ..... 51/5 D; 51/165.87; 125/11 R; 125/11 CD

[58] Field of Search ..... 51/5 D, 165 R, 165.77, 51/165.87, 165.88; 125/11 CD, 11 R

[56] References Cited

U.S. PATENT DOCUMENTS

| | | | |
|---|---|---|---|
| 3,113,563 | 12/1963 | Hughes | 125/11 CD |
| 3,760,539 | 9/1973 | Robillard | 51/165.88 |
| 4,051,830 | 10/1977 | Gruber | 125/11 CD |

*Primary Examiner*—Harold D. Whitehead
*Attorney, Agent, or Firm*—Robert E. Burns; Emmanuel J. Lobato; Bruce L. Adams

[57] ABSTRACT

A grinding machine control apparatus comprises revolution speed changing means effective to selectively change a high speed in the grinding or a low speed in the dressing operations, a change signal generating means to generate a dressing initiation signal after the lapse of a predetermined time after a grinding wheel spindly driving motor is turned off, and control means to change said revolution speed changing means in response to a change signal from said change signal generating means and operative to drive a driving motor of a grinding wheel at a predetermined low speed of revolution. In a high-speed grinding machine, the speed of revolution of a grinding wheel spindle is automatically changed to reduce from a high revolution speed in the grinding operation to a low speed in the dressing operation without stopping a grinding wheel spindle so that a dressing operation can be carried out with good efficiency and a grinding wheel profile accuracy is substantially improved.

6 Claims, 7 Drawing Figures

CONTROL APPARATUS FOR A GRINDING MACHINE

BACKGROUND OF THE INVENTION

This invention relates generally to a control device of a grinding machine to automatically change the speed of revolution of a grinding wheel from a high speed during grinding to a low speed during dressing. Conventionally, it is known that in a grinding machine having a single-point diamond dresser, when the speed of revolution of a grinding wheel is greatly increased to improve the grinding efficiency, a speed of revolution for dressing lower than that of grinding is much better in order to dress the grinding wheel more precisely and sharply and to make a diamond dresser last longer. Therefore, dressing is conventionally carried out with a dressing operation initiated when a driving motor of the grinding wheel is perfectly stopped, and thereafter the speed of revolution of the grinding wheel is changed to the low revolution speed by way of replacing a drive belt or changing to another motor. But, especially in a cylindrical grinding machine, the moment of inertia of the grinding wheel is so large that the grinding wheel normally continues to rotate about a minute after an electric motor is turned off and so the time therebetween is wasted.

While, if a driving motor is braked to shorten the loss-time, a fastening screw provided on both a grinding wheel spindle and grinding flange is acted thereon by a torque in a direction effective to loosen the fastening screws. This dangerous state prevents automation therewith. As set forth above, conventionally after the speed of revolution of a grinding wheel is reduced and the grinding wheel is stopped naturally, a revolution speed changing operation is manually carried out or a low revolution (low speed) which does not effect dressing is maintained, namely both grinding and dressing are accomplished without changing the speed thereof.

SUMMARY OF THE INVENTION

The object of this invention is to provide a grinding machine control apparatus effective to improve the grinding efficiency and to sharply and precisely carry out wheel dressing and to prolong the diamond dresser life by way of automatically changing the speed of revolution of the grinding wheel spindle driving motor from a high speed in the grinding to a low speed in the dressing operations.

A control apparatus for a grinding machine according to this invention comprises change signal generating means which may be a timer or some other structure. A timer operating as a change signal generating means is set at the predetermined time which is equal to the time that a grinding wheel spindle naturally slows from a high speed of revolution in the grinding operation to a low speed in the dressing operation after turning off an electric source of the motor. Another change signal generating means is provided with a revolution speed detection device to detect a speed of revolution of a grinding wheel spindle driving motor and a revolution speed reduction detection circuit for comparing a revolution speed detected by said revolution number detection means with a previously set determined revolution speed in the dressing operation so that a grinding wheel spindle can be effectively changed to a low revolution speed of the dressing operation when it naturally slows from a high revolution speed of the grinding operation and attains a low speed of revolution.

DESCRIPTION OF PREFERRED EMBODIMENTS

Figure 1:
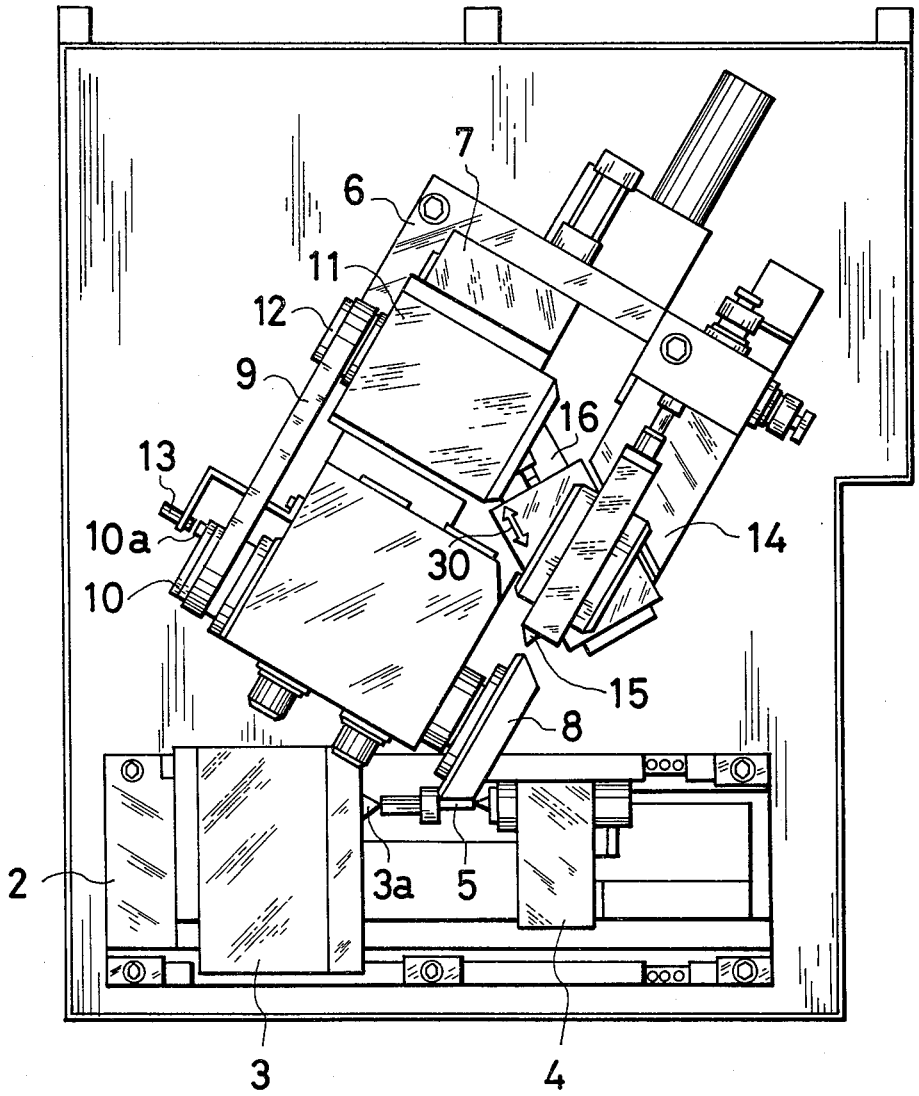
FIG. 1 is a front view of an embodiment of a cylindrical grinding machine provided with a grinding machine control apparatus according to the present invention.

A preferred embodiment of this invention applied to a cylindrical grinding machine with a forming grinding wheel is hereinafter described with reference to the accompanying drawings. In FIG. 1, reference numeral 1 is a base of a cylindrical grinding machine and reference numeral 2 is a horizontal table mounted on the base 1. Numeral 3 is a headstock fixed on the table 2 and reference numeral 4 is a tailstock oppositely mounted on the table 2, wherein the tailstock 4 is mounted on the table 2 and is operative to travel forward and backward relative to the headstock 3.

Reference numeral 5 is a workpiece with the center thereof supported between the headstock 3 and the tailstock 4 and which is rotationally driven by a main shaft 3*a* within the headstock 3. Reference numeral 6 is a slidebase mounted on the base 1. Reference numeral 7 is a wheel head slide for plunge grinding mounted on the slidebase 6 and is operative to travel obliquely forward and backward relative to the workpiece 5. A wheel support has mounted thereon a freely rotatory grinding wheel spindle at the suitable angle relative to the workpiece 5 (about 30°) and at a tip end thereof is mounted a forming grinding wheel 8 formed corresponding to the finished workpiece configuration. Reference numeral 9 is a belt wound around a pulley 10 attached to a rear end of said grinding wheel spindle and a pulley 12 attached to an output shaft of the driving motor 11 mounted on the wheel support 7. The driving motor 11 can be operated at two speeds; in the grinding operation the grinding wheel 8 can be rotationally driven at high speed (45 m/s) and in the dressing operation can be rotationally driven at a lower speed.

Namely, the driving motor 11 is, for example, an induction motor and provided with a solid state generator supplying an electric signal having a lower frequency than a commercial power supply so that in the grinding operation it can be rotationally driven at low speed by use of the low frequency of a generator supplied with a commercial power supply. Otherwise, a pole-change motor is used as a driving motor 11 and thereby in the grinding operation a high speed is obtained by changing to fewer poles and in the dressing operation a low speed is obtained by changing to more poles. In addition, as a method to change the speed of revolution of the motor shaft, there is a method for converting the voltage by use of a direct current motor. But, in the case of the grinding machine, it is better to use an induction motor or pole-change motor, because of the limited life of the commutator and the generation of vibration in the direct current motor.

Numeral 13 is a proximity detector for detecting a speed of revolution of a grinding wheel mounted on a wheel support 7 opposite to the pulley 10 and the detector 13 generates a pulse signal every time that a projection 10*a* projecting from the pulley 10, passes thereby, namely at every one revolution of the grinding wheel spindle. Reference numeral 14 is a tracer type dressing device which is provided at the rear side of the wheel support, and in this embodiment there is used a tracer type dressing device provided with a single point diamond dresser 15 at its tip end. This tracer type dressing device 14 is operative to go forward and backward in the direction of arrow 30 on the base 16 mounted on the slidebase 6 of the wheel support. Also, the dressing device has a built-in template having the same configuration as a finish configuration of the workpiece 5. (Which is not illustrated) The dresser 15 carries out a dressing of the grinding wheel by being fed along the template and transcribes the template configuration to the circumference of the grinding wheel 8.

Figure 2:
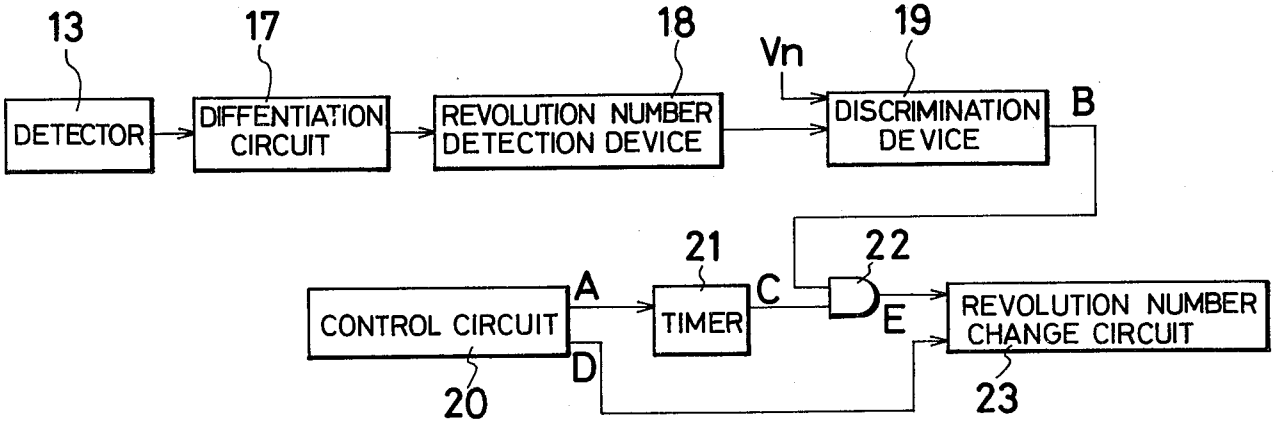
FIG. 2 is a block diagram illustrating an embodiment of the grinding machine control apparatus of this invention.

Now, referring to a block diagram of FIG. 2, there is disclosed an embodiment of a control device of this invention which controls the grinding machine. In FIG. 2, reference numeral 13 is a detector for detecting the speed of revolution of the grinding wheel spindle. As set forth above, this detector 13 generates a pulse signal at every revolution of the grinding wheel spindle, and a signal from the detector 13 is differentiated by the differentiation circuit 17 and altered to a narrow pulse. In the revolution speed detector 18, an output signal is produced corresponding to the rotation speed, based on the period of the pulses applied from the differentiation circuit 17 and this output signal is discriminated in the discrimination device 19 having a standard preset value N3 which is lower than the revolution speed N2 in the dressing operation. The revolution speed reduction signal B is produced from the discrimination device 19 as the speed of revolution of the grinding wheel spindle is reduced to a value less than the standard preset value VN3.

Numeral 20 is a control circuit of a grinding machine into which a signal from a position detection device for detecting the position of the dresser 15, a grinding wheel or the like is applied in order to obtain a control signal. Reference numeral 21 is a timer connected to the control circuit 20 and is preset to a predetermined time Tc which is slightly longer than the previously examined time which corresponds to the time wasted while the revolution speed of a grinding machine decreases naturally into the low revolution speed for dressing, after an electric source for operating the driving motor at high speed is turned off.

Figure 3:
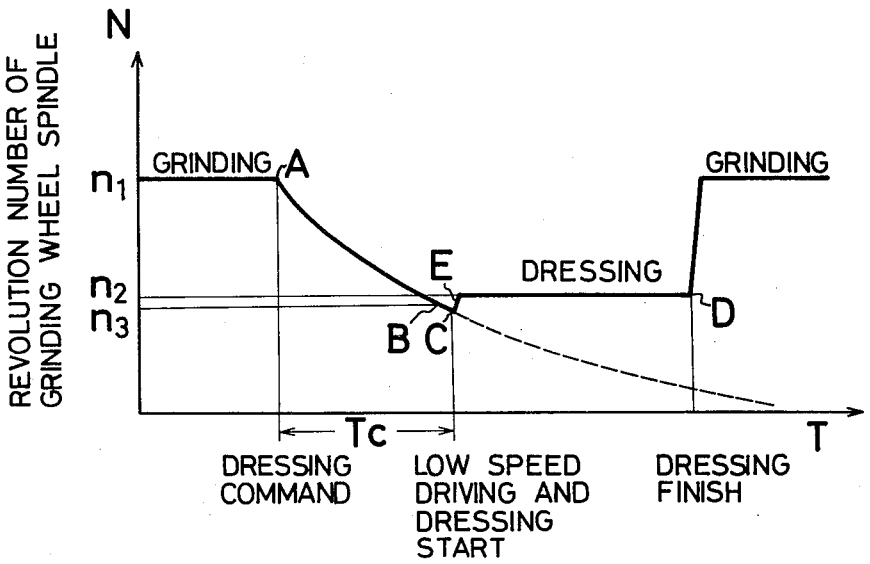
FIG. 3 is a graph showing a change with the passage of time of the revolution speed of grinding wheel spindle after dressing command.

Namely, when grinding of some workpiece is finished and a dressing command signal A from the control circuit 20 is produced to initiate the dressing operation and an electric source for operating the grinding wheel spindle driving motor 11 is turned off by the signal A, the revolution speed N of the grinding wheel spindle gradually decreases from the revolution speed N1 of the grinding as shown in FIG. 3. While at the same time, the timer 21 is energized by the signal A and when a preset time Tc has passed, a dressing start signal C is produced. The signal C and the output signal B from the discrimination device 19 are applied to the AND gate 22 (which is illustrated in FIG. 2) and when both signals B and C are produced a signal is applied to the revolution speed change circuit 23 to change the revolution speed of the grinding wheel spindle driving motor 11 so that the revolution speed is changed and the driving motor is rotated at low speed. When dressing finish signal D is produced from the control circuit 20 in accordance with the output signal of the dresser position detection device, the grinding wheel spindle driving motor 11 is operated at high speed by the revolution change circuit 23 and thus grinding of the workpiece is initiated again.

As set forth above, in this control device, a grinding wheel spindle driving motor is changed to the low speed by an output signal derived from the logical AND combination of respective output signals of timer and a discriminator circuits, wherein a preset time of the timer is determined by previously examining the time that the revolution speed of the grinding wheel decreases naturally from the revolution speed N1 of the grinding operation to the revolution speed N2 of the dressing operation. In said discriminator, there is a standard preset value of a lower speed of revolution than the speed of revolution of the dressing operation and an output is produced when the revolution speed detection device of the grinding wheel spindle is reduced to a value lower than the preset value, so that even though an error signal is produced due to noise in the revolution speed detector system or the actual revolution reduction time become much longer than the preset time of the timer by virtue of the viscosity reduction of bearing lubricating oil, a change signal of the motor is not produced before the speed of revolution thereof is reduced to less than the revolution speed N2 of the dressing operation and so the device is very reliable and safe.

As set forth above, in a grinding machine provided with a headstock to support a workpiece and to deliver a rotary force thereto, a wheel support having a grinding wheel effective to draw near or away from a workpiece, a driving motor to rotate the grinding wheel and operative to change the revolution speed of the grinding wheel, and a dresser to dress a grinding wheel, a control device of the grinding machine according to this invention comprises a revolution speed change means to change a revolution speed of the driving motor to a high revolution speed for grinding or a low revolution speed for dressing, a revolution speed detection circuit to detect the revolution speed of the grinding wheel spindle, a revolution speed reduction detection circuit produces a signal when a revolution speed detected by a revolution speed detection means is less then the revolution speed for dressing, and a timer previously set to a predetermined time delay. The speed of revolution of the driving motor, after an electric source for the motor is turned off, decreases from a high grinding speed to a low dressing speed, an output signal produced from said timer turns off the driving motor with dressing initiation and a control means to change a revolution speed change means by AND gate signal derived from both said output signal and an output signal of the revolution speed reduction detection circuit, and thus a revolution speed of the grinding wheel spindle can be changed automatically and in safety in a short time. This invention has advantages in that grinding efficiency is improved and a highly precise and safe dressing is carried out and a dresser can be made to last extremely long.

In a conventional high speed grinding machine, a single point diamond dresser has a fairly short life so that only an expensive rotary diamond dresser is utilized, while in the grinding machine of this invention wherein the speed of revolution is reduced in dressing, an inexpensive single point diamond dresser can be used. In addition, speed of revolution of the grinding wheel spindle is able to be reduced during dressing to thereby make a dress pitch larger. Thus sharpness of the grinding wheel is improved and grinding efficiency is extremely improved and also, in a profile dressing device, a profile feeding speed is effectively greatly reduced (if profile feeding speed is reduced in a condition of high speed of revolution of the grinding wheel spindle, the dress pitch becomes smaller) so that the tracing accuracy against the template, that is, profile accuracy is able to be improved and dressing and grinding of a precise and complicated configuration is effectively carried out.

Figure 4A:
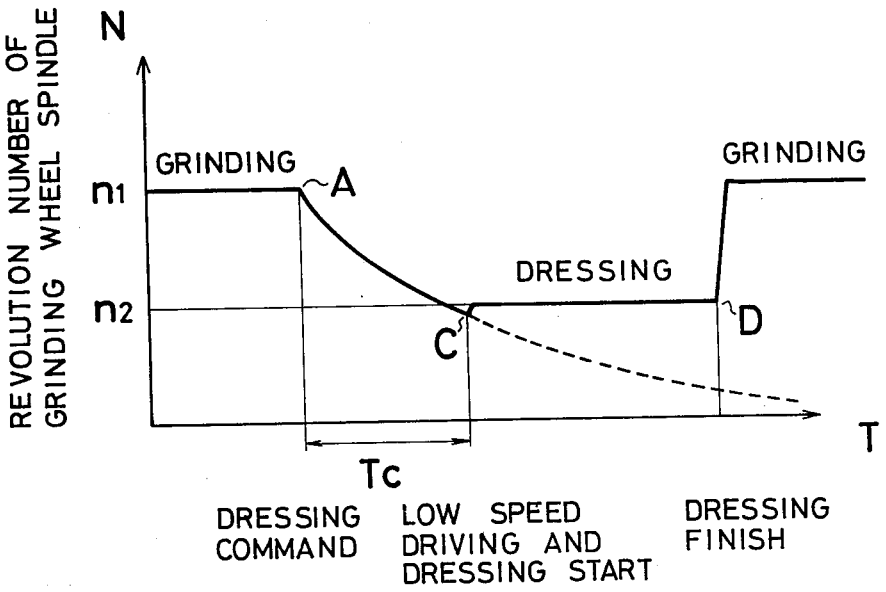
FIG. 4(A) is a graph showing a change with the passage of time of the revolution speed of a grinding wheel spindle in another embodiment of this invention.
Figure 4B:
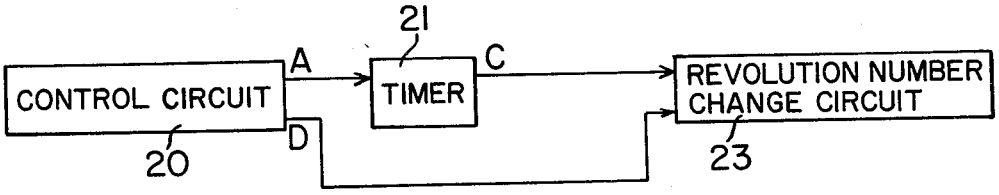
FIG. 4(B) is a block diagram illustrating a second embodiment of the grinding machine control apparatus according to the present invention having an operating mode illustrated by the graph shown in FIG. 4(A)

Next, there is disclosed a second embodiment of a cylindrical grinding machine of this invention illustrated in FIG. 4(B). The second embodiment has the same construction as that of the first embodiment, but does not have a revolution speed detection means as a change signal generating means. The second embodiment has the same structure as shown in FIG. 1 except that there is no revolution speed grinding wheel spindle detector mounted on the wheel support 7 and with a protection 10*a* protruding on a pulley 10. Herein after a control system of the grinding machine of this invention is described.

In the control circuit of the grinding machine a signal from a position detection device is applied to detect a position of the grinding wheel 8 and a dresser 15 in order to obtain a control signal, and the control circuit is provided with a timer which is energized when a dressing command signal is produced and an electric source of driving motor 11 is turned off whereby a signal is generated after the elapse of the predetermined time to change the driving motor to the lower speed of revolution of the dressing operation. Previously, the time required for the revolution speed of the grinding wheel spindle to decrease to the low revolution speed of the dressing operation, after an electric source of a driving motor 11 in a high revolution speed region is turned off, is determined, and said timer is previously set at this time to set the predetermined time Tc.

Accordingly, when grinding of the some workpieces is accomplished in accordance with a control signal from the control circuit, the dressing command signal A is produced from a control circuit to initiate a dressing process and with this signal A an electric source of the grinding wheel spindle driving motor 11 is turned off. Thus the revolution speed N of the grinding wheel spindle, as shown in FIG. 4, is gradually reduced from a revolution speed N1 of grinding. While, at the same time the timer is enabled by the signal A and the predetermined time Tc elapses, and then a dressing start signal C is produced and the driving motor 11 is changed to drive at a low speed of revolution of the dressing operation (revolution speed N2). But when a dressing finish signal D is produced from the control circuit in accordance with an output signal of the position detection device of the dresser, the grinding wheel spindle driving motor is changed to a high speed of revolution so that grinding of a workpiece is started again. Thus, a predetermined time Tc of the timer is determined by previously determining the time required for the grinding wheel spindle to slow down from a revolution speed N1 of the grinding operation to a revolution speed N2 of the dressing operation so that the revolution speed of the grinding wheel spindle becomes less than the revolution speed N2 of the dressing operation when the dressing start signal C is generated. The grinding wheel can be changed from a high speed in the grinding to a low speed in the dressing operations in a minimum time without braking the grinding wheel, that is, acting thereon applying a torque in the decelerating direction.

Figure 5A:
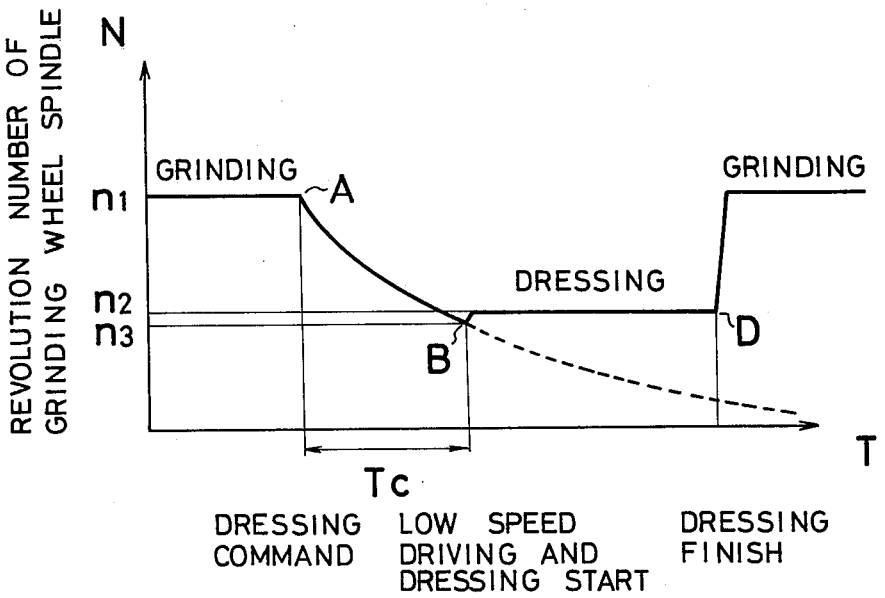
FIG. 5(A) is a graph showing a change with the passage of time of the revolution speed of a grinding wheel spindle in a third embodiment of this invention.
Figure 5B:
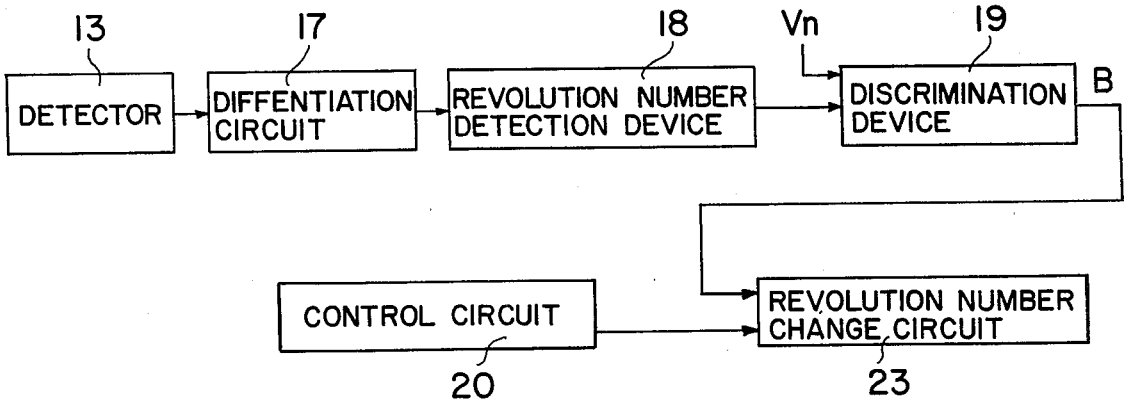
FIG. 5(B) is a block diagram illustrating a third embodiment of the grinding machine control apparatus according to the present invention having an operating mode illustrated by the graph shown in FIG. 5(A).

Next, there is disclosed the third embodiment of a cylindrical grinding machine of this invention illustrated in FIG. 5(B). This third embodiment has almost the same construction, as illustrated in FIG. 1 of the first embodiment, but it does not have a timer as a change signal generating means but only a revolution speed detection device. Hereinafter a control system of the grinding of this embodiment is described. In the control cirucit of the grinding machine a signal from a position detection circuit or the like is applied to detect a position of the wheel support 8 and a dresser 15 in order to obtain a signal from a detector 13 and an output signal of the control circuit. While, the grinding of some workpieces is accomplished in accordance with a control signal from the control circuit and a dressing order signal A is produced from a control circuit to intiate the dressing operation, an electric source of the grinding wheel driving motor 11 is turned off and thereafter the revolution speed N of the grinding wheel spindle is gradually slowed down from the revolution number N1 of the grinding operation. The revolution speed is obtained in accordance with a period of a pulse signal produced from said detector 13 and by comparing said signal with a comparative value previously set at the lower speed of revolution N3 which is lower than the revolution speed N2 of the dressing operation, a dressing start signal B is produced when the revolution speed of the grinding wheel spindle is reduced to less than the comparative revolution speed N3 and thereby the driving motor 11 is changed to drive at a low revolution speed of the dressing operation.

Thereafter when the dressing finish signal D is produced from the control circuit in accordance with an output signal of the position detection device of the dresser, the grinding wheel spindle driving motor 11 is changed to a high revolution speed and the grinding of the workpieces is resumed. Thus the revolution speed of the grinding wheel spindle is detected by a detector 13 and the dressing start signal B is produced at the moment that the revolution speed thereof is reduced to less than the speed of revolution used in the dressing operation and the grinding wheel spindle driving motor is changed to drive with the low revolution speed so that the motor can be changed from a high speed of revolution in the grinding operation to a low speed in the dressing operation in a minimum time without braking the grinding wheel spindle or applying to the grinding wheel a torque in a loosening direction thereof.

What we claim is:

1. A control apparatus for a grinding machine provided with a headstock to support a workpiece and to apply a rotatory force thereto, a wheel support having a grinding wheel effective to move against or away from a workpiece, and a variable speed of revolution driving motor for rotating the grinding wheel, the control apparatus comprising: revolution speed changing means for selectively changing the speed of revolution of the driving motor to a high speed in the grinding operation or a low speed in the dressing operation; change signal generating means for generating a dressing command signal when the revolution speed of the grinding wheel is reduced to a predetermined low revolution speed after the driving motor is turned off to thereafter initiate a dressing operation; and control means cooperative with said revolution speed changing means and said change signal generating means for enabling the driving motor to operate at the low dressing speed in response to selection of the low dressing speed and generation of the dressing command signal.

2. In a control apparatus in a grinding machine as defined in said claim 1; said change signal generating means is comprised of a timer set at the predetermined time interval required for the revolution speed of the driving motor to slow from a high speed in the grinding operation to a low speed in the dressing operation after said driving motor is turned off in response to the dressing command signal.

3. In a control apparatus in a grinding machine as defined in said claim 1; said change signal generating means is comprised of revolution speed detection means for detecting a speed of revolution of the driving motor; and a revolution speed reduction detection circuit for comparing a revolution speed detected by said revolution speed detection means with a previously determined revolution speed of the dressing operation and for generating a signal when the detected signal is reduced to a lower revolution speed value than the revolution speed value in the dressing operation.

4. In a control apparatus in a grinding machine as defined in said claim 1; said change signal generating means is comprised of revolution speed detection means for detecting a speed of revolution of the grinding wheel spindle; and a revolution speed reduction detection circuit for comparing a revolution speed detected by said revolution speed detection means with a previously determined revolution speed of the dressing operation and for generating a signal when the detected signal is reduced to a lower revolution speed value than the revolution speed value in the dressing operation.

5. In a control apparatus in a grinding machine as defined in said claim 1; said change signal generating means is comprised of revolution speed detection means; a revolution speed reduction detection circuit for comparing a detected revolution speed with a previously set value and for generating a signal when the detected signal is reduced to less than said set value; a timer set at a predetermined time interval to generate a signal after the lapse of said predetermined time; and an AND circuit connected for receiving an output signal from said timer and an output signal from said revolution speed reduction detection circuit to develop an output signal for controlling said revolution speed change circuit in order to change the revolution speed of the grinding wheel spindle.

6. In a control apparatus in a grinding machine as defined in said claims 2 or 5, wherein the detected output signal obtained from said revolution speed detection means and a previously set value in said revolution speed reduction detection circuit are respectively narrow pulse signals having periods corresponding to the speed of revolution.

* * * * *